US005622818A

United States Patent [19]

Kapp et al.

[11] Patent Number: 5,622,818

[45] Date of Patent: Apr. 22, 1997

[54] COLOR PHOTOGRAPHIC ELEMENTS CONTAINING YELLOW COLORED MAGENTA DYE FORMING MASKING COUPLERS

[75] Inventors: Daniel L. Kapp; Janet N. Younathan, both of Rochester, N.Y.; Robert J. Ross, Elmhurst, Ill.; James P. Merrill, Rochester, N.Y.

[73] Assignee: Eastman Kodak Company, Rochester, N.Y.

[21] Appl. No.: 564,515

[22] Filed: Nov. 29, 1995

[51] Int. Cl.[6] ..... G03C 7/333

[52] U.S. Cl. ..... 430/555; 430/549; 430/359

[58] Field of Search ..... 430/359, 555, 430/549

[56] References Cited

FOREIGN PATENT DOCUMENTS

| | | | |
|---|---|---|---|
| 0113935 | 7/1983 | Japan | 430/555 |
| 0117545 | 7/1983 | Japan | 430/555 |

*Primary Examiner*—Lee C. Wright
*Attorney, Agent, or Firm*—Joshus G. Levitt

[57] ABSTRACT

A multilayer silver halide color photographic element comprising a support bearing a light-sensitive silver halide emulsion layer and a non-diffusible yellow-colored magenta dye-forming masking coupler wherein the masking coupler is a 2'-hydroxy-5'-substituted-4-phenylazo-5-pyrazolone. The masking coupler has good coupling activity and desirable hues, and can be obtained in good yields by simple syntheses.

7 Claims, No Drawings

COLOR PHOTOGRAPHIC ELEMENTS CONTAINING YELLOW COLORED MAGENTA DYE FORMING MASKING COUPLERS

FIELD OF THE INVENTION

This invention relates to color photographic elements containing particular magenta dye-forming masking couplers.

BACKGROUND OF THE INVENTION

Most silver halide color photographic elements form multicolor images in the element by subtractive color mixing. This involves the formation of yellow, magenta and cyan dye images by color development of imagewise exposed blue, green and red sensitive silver halide emulsion layers. Ideally, the subtractive dyes so formed should absorb radiation only in the region of the spectrum which is the complement of the region of exposure. Unfortunately, all dyes have some unwanted side absorptions. To correct for these unwanted side absorptions it is common practice for color negative photographic elements to employ one or more colored masking couplers. These couplers have a color which is similar to the unwanted side absorption of one of the dyes formed from one of the image couplers. The color of the masking coupler is destroyed in the areas of the image where the dye with unwanted side absorptions is formed. The way in which colored masking couplers are employed to correct for the unwanted side absorption is described in more detail in J. Phot. Soc. Am. 13, 94(1947), J. Opt. Soc. Am. 40, 166(1950) and J. Am. Chem. Soc. 72, 1533(1950).

A preferred class of colored masking couplers are the 4-phenylazo-5-pyrazolones which correct for the unwanted yellow side absorption of magenta dye-forming couplers. Such couplers have found widespread use in color photographic elements. Nevertheless, it has been reported, for example in U.S. Pat. Nos. 4,070,191, 4,163,670, and 5,219,719, that the coupling activity of this class of couplers can be increased if the 4-phenylazo group is substituted in certain ways. Among the phenylazo groups suggested in these patents are 2'-hydroxy-4'-substituted phenylazo groups. While such groups provide masking couplers with good activity and desired hues, they are difficult to synthesize because of the presence of the 4'-substituent. Although such a substituent can provide a desired hue to the colored coupler, its presence complicates the synthesis and decreases the yield of coupler. Specifically, during the formation of the precursor for the phenylazo group, not only is there formed the desired isomer in which the 4'-substituent is meta to the 2'-hydroxy group and para to the azo group precursor, but there are formed two undesired isomers in which the 4'-substituent is ortho to the azo group precursor. A yield reducing separation step is required to isolate the desired precursor. It would be desirable to provide colored pyrazolone masking couplers that not only have good coupling activity and desirable hues but which can be obtained in good yields by simple syntheses.

SUMMARY OF THE INVENTION

We have found that a 2'-hydroxy-5'-substituted phenylazo group reduces the possibility of isomer formation in the precursor and thus increases the yield of masking coupler. Further, we have found that a 5'-substituent provides masking couplers of similar hues to ones with a 4'-substituent.

Thus, the present invention provides a multilayer silver halide color photographic element comprising a support bearing a light-sensitive silver halide emulsion layer and a non-diffusible yellow-colored magenta-dye forming masking coupler wherein the masking coupler is a 2'-hydroxy-5'-substituted-4-phenylazo-5-pyrazolone.

The present invention provides colored pyrazolone masking couplers that have good coupling activity and desirable hues and which can be obtained in good yields by simple syntheses.

DETAILED DESCRIPTION OF THE INVENTION

In a preferred embodiment, the non-diffusible masking coupler is represented by the structural formula:

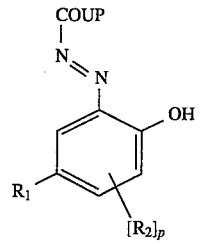

wherein:

COUP is a 5-pyrazolone dye-forming coupler having the azo group attached to its coupling position;

$R_1$ and $R_2$ each independently represents a substituent with a Hammett sigma-para value of less than 0.05, or together $R_1$ and $R_2$ or two $R_2$s represents a substituent with a Hammett sigma-para value of less than 0.05; and p is an integer of 0 to 3.

In a preferred embodiment;

$R_1$ and $R_2$ each independently are an alkyl group, an aryl group, an amino group, an amido group, a ureido group, an alkoxy group, or an aryloxy group, or together $R_1$ and $R_2$ represent an alkylene group; and and p is an integer of 0 to 3.

In a particularly preferred embodiment;

$R_1$ is an alkyl group of 1 to 10 carbon atoms;

$R_2$ is a 3'-alkyl group of 1 to 10 carbon atoms; and p is 0 or 1.

Hammett sigma-para values are a measure of the electron donating propensity of the substituent, and are described in *Substituent Constants for Correlation Analysis in Chemistry and Biology*, C. Hansch and A. J. Leo, Wiley, New York, 1979. Preferably, the substituents individually have Hammett sigma-para values in the range of −0.10 to −0.35 and together all $R_1$ and $R_2$ groups have Hammett sigma-para values in the range of −0.10 to −0.50.

Examples of suitable $R_1$ and $R_2$ groups are straight or branched alkyl, such as methyl, ethyl, n-propyl, i-propyl, n-butyl, s-butyl, t-butyl, tamyl, n-docecyl, 1,1,3,3-tetramethylbutyl and 3-(2,4-di-t-amylphenoxy)propyl; straight or branched alkoxy, such as methoxy, ethoxy and t-butoxy; aryl, such as phenyl, 4-t-butylphenyl and 2,4,6-trimethylphenyl; aryloxy, such as phenoxy and 2-methylphenoxy; ureido, such as phenylureido and methylureido; amido, such as acetamido and pivalamido; amino, such as dimethytamino and morpholino; or $R_1$ and $R_2$ together are alkylene group such as n-propylene, n-butylene, n-pentylene and n-hexylene.

COUP can be any of the 5-pyrazolone couplers known fin the art. Preferred couplers are 5-pyrazolone couplers having an anilino group in the 3-position.

The masking couplers of this invention are rendered non-diffusible as coated in the photographic element by the presence on the coupler of a ballast group. A ballast group is a group of such size and configuration that, in combination with the remainder of the molecule, it provides the coupler with sufficient bulk to be substantially non-diffusible from the layer in which it is coated in the element. The ballast group can be part of COUP, as is the case with dye-image forming couplers. Alternatively, the ballast group can be on the phenylazo group, in which case the dye formed on coupling may be diffusible. Representative ballast groups include alkyl or aryl groups containing 6 to 32 carbon atoms. Other ballast groups include alkoxy, aryloxy, arylthio, alkylthio, alkoxycarbonyl, aryloxycarbonyl, carboxy, acyl, acyloxy, carbonamido, carbamoyl, alkylcarbonyl, arylcarbonyl, alkysulfonyl, arylsulfonyl, sulfamoyl, sulfenamoyl, alkylsulfinyl, arylsulfinyl, alkylphosphonyl, arylphosphonyl, alkoxyphosphonyl, and arylphosphonyl of 6 to 32 carbon atoms.

As used herein, unless otherwise indicated the alkyl and aryl groups, and the alkyl and aryl portions of other substituent groups, can be unsubstituted or substituted with non-interfering substituents. Typical alkyl groups have 1 to 32 carbon atoms and typical aryl groups have 6 to 32 carbon atoms. Depending upon the position of the group, preferred alkyl groups can have 1 to 20 carbon atoms, 1 to 12 carbon atoms or 1 to 4 carbon atoms and preferred aryl groups can have 6 to 20 or 6 to 10 carbon atoms. Other groups which contain a replacable hydrogen atom can be substituted or not, depending on the particular structure and properties desired.

Throughout this application a reference to any type of chemical "group" includes both the unsubstituted and substituted forms of the group described. Generally, unless otherwise specifically stated, substituent groups usable on couplers herein include any groups, whether substituted or unsubstituted, which do not destroy properties necessary for their use as masking couplers. Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); and others known in the art. Alkyl substituents may specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

Table I, below, depicts as M-1 through M-18 examples of preferred pyrazolone coupler parents to whose coupling position (represented by a single bond in the 4-position of the pyrazolone ring) a 2'-hydroxy-5'-substituted phenylazo group can be joined.

Table II, below, depicts as AZ-1 through AZ-18 preferred 2'-hydroxy-5'-substituted phenylazo groups that can provide masking couplers of this inventions.

Table III, below, depicts as I-1 through I-22 preferred colored masking couplers of this invention.

TABLE I

M-1

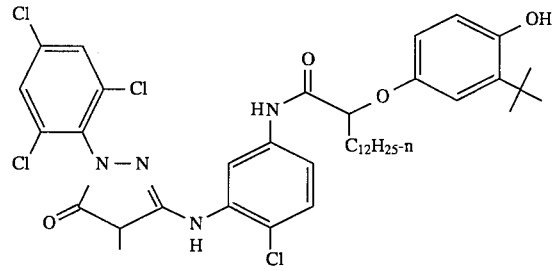

M-2

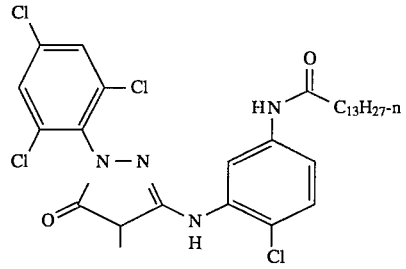

TABLE I-continued
M-3
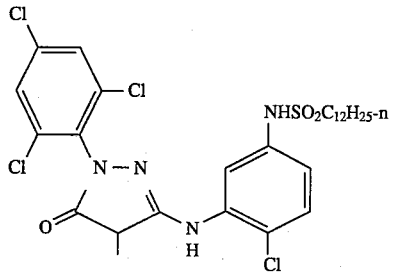
M-4
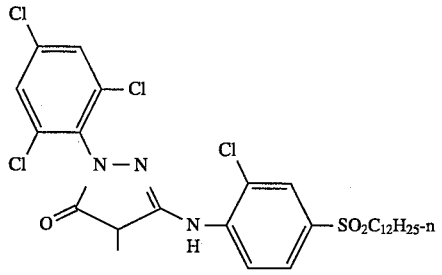
M-5
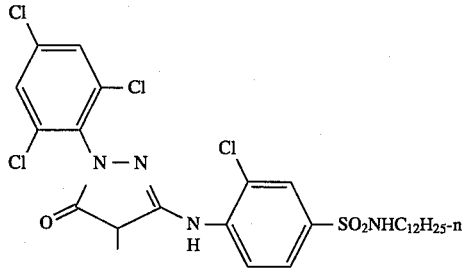
M-6
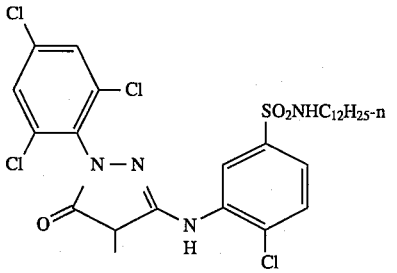
M-7
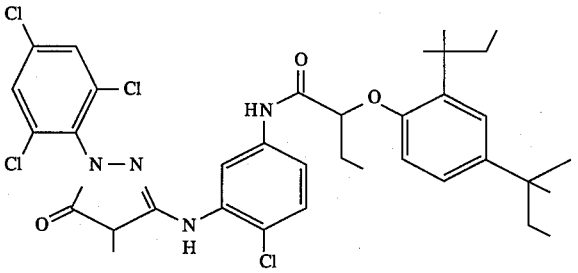
M-8
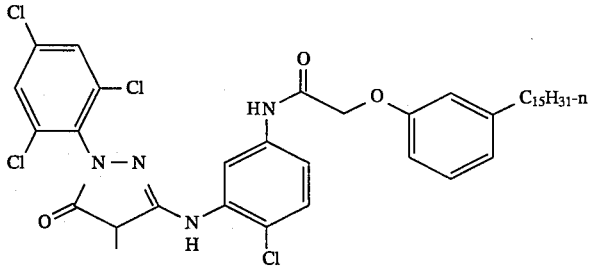

TABLE I-continued
M-9
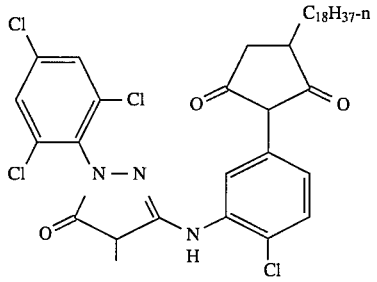
M-10
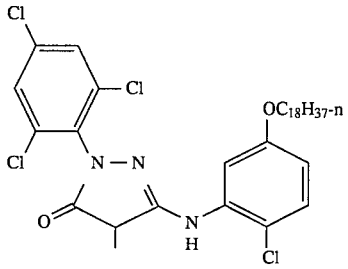
M-11
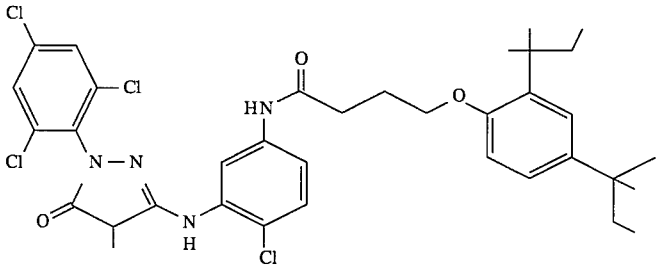
M-12
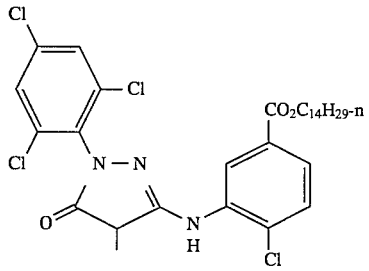
M-13
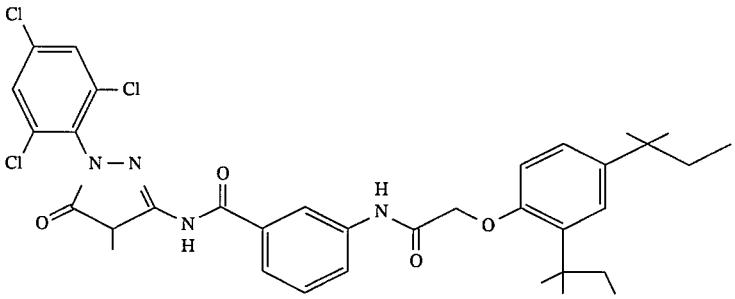

TABLE I-continued
M-14
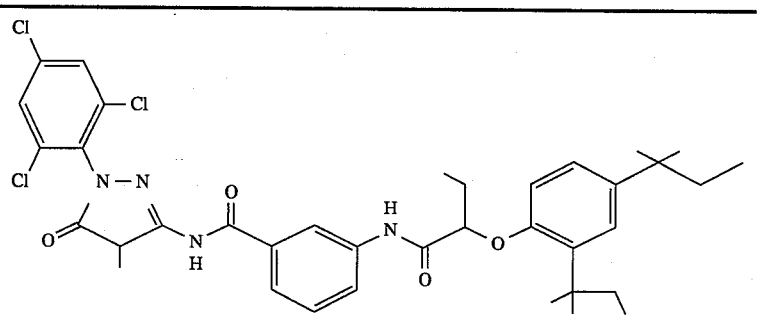
M-15
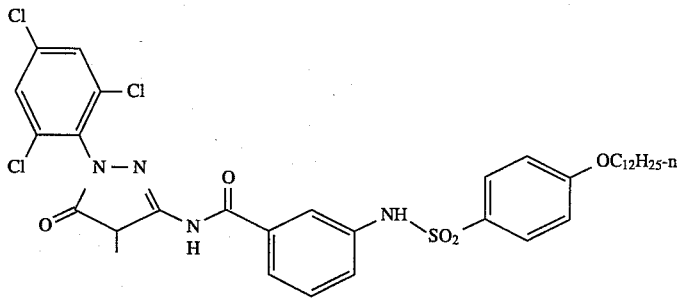
M-16
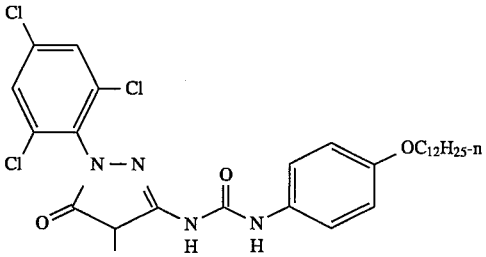
M-17
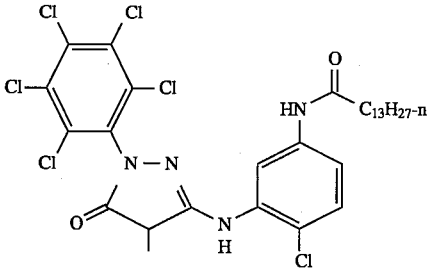
M-18
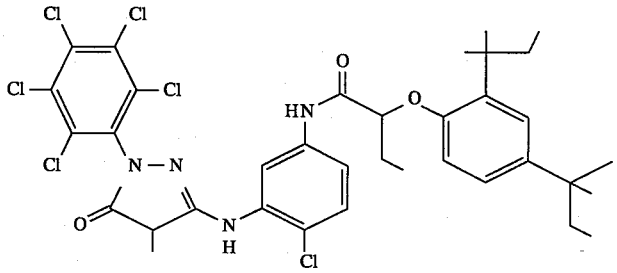
TABLE II
AZ-1
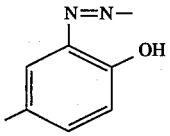
AZ-2
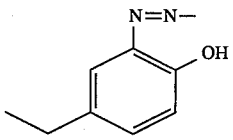

TABLE II-continued
| | | | |
|---|---|---|---|
| AZ-3 | 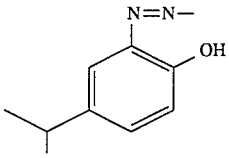 | AZ-4 | 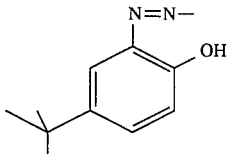 |
| AZ-5 | 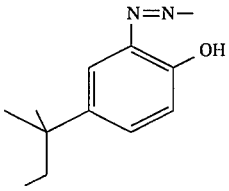 | AZ-6 | 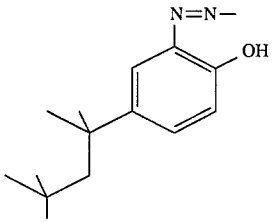 |
| AZ-7 | 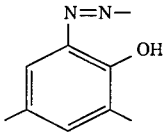 | AZ=8 | 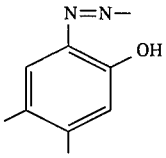 |
| AZ-9 | 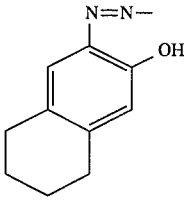 | AZ-10 | 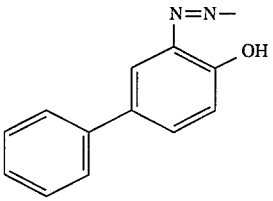 |
| AZ-11 | 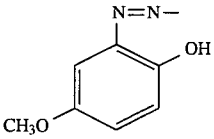 | AZ-12 | 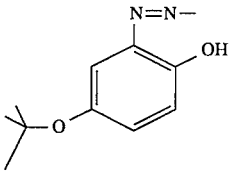 |
| AZ-13 | 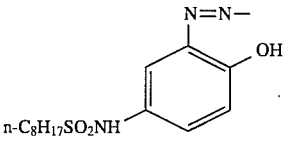 | AZ-14 | 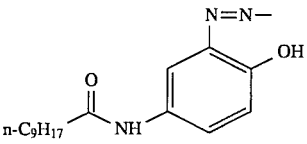 |
| AZ-15 | 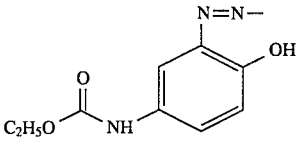 | AZ-16 | 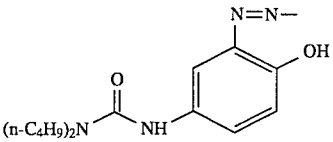 |
| AZ-17 | 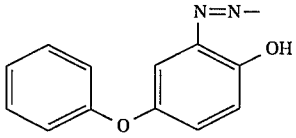 | AZ-18 | 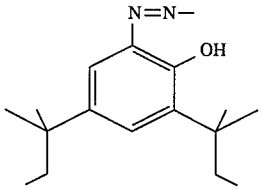 |

TABLE III
I-1
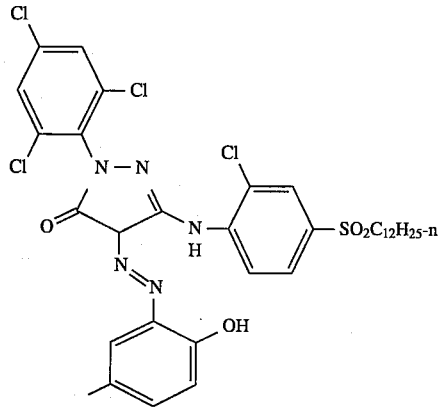
I-2
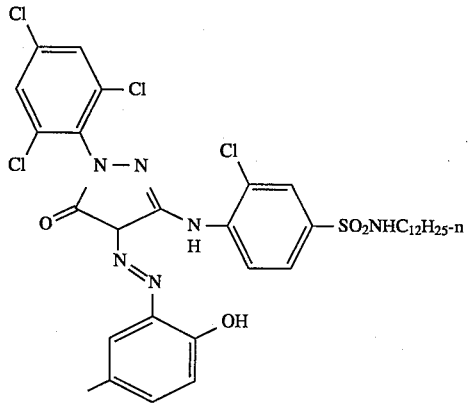
I-3
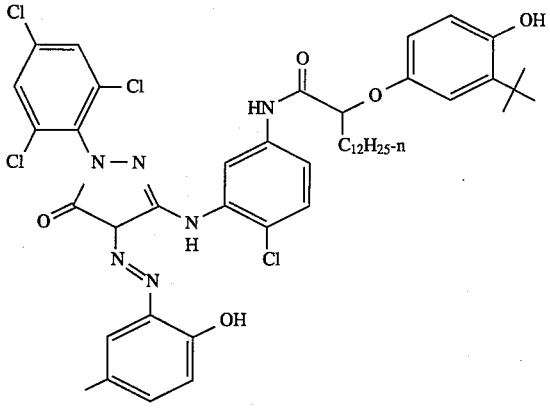
I-4
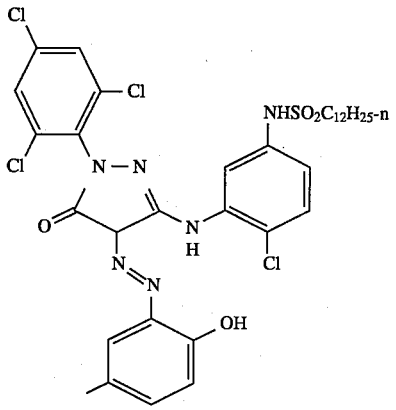

TABLE III-continued
I-5
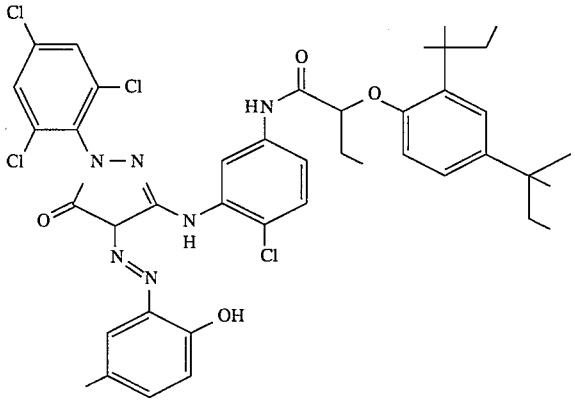
I-6
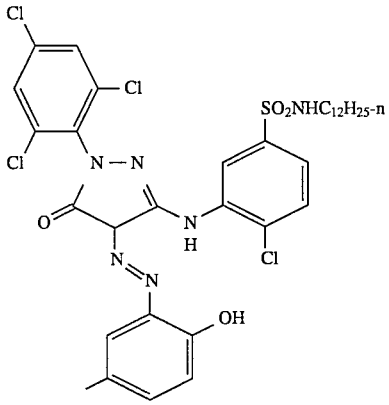
I-7
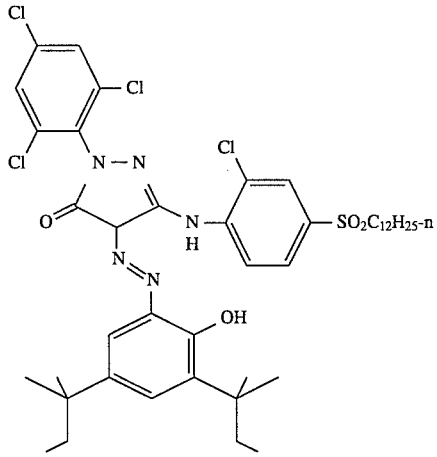

TABLE III-continued
I-8
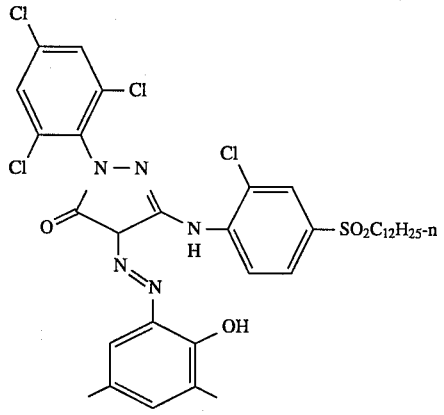
I-9
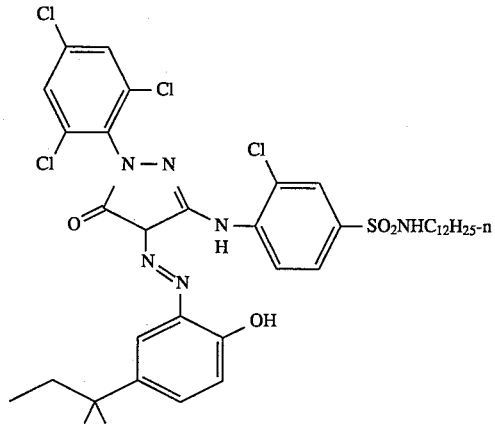
I-10
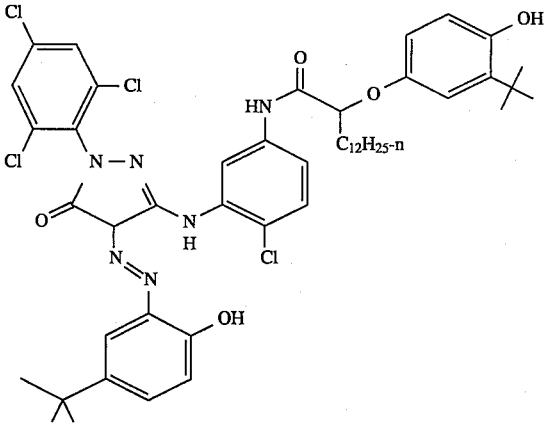

TABLE III-continued
I-11
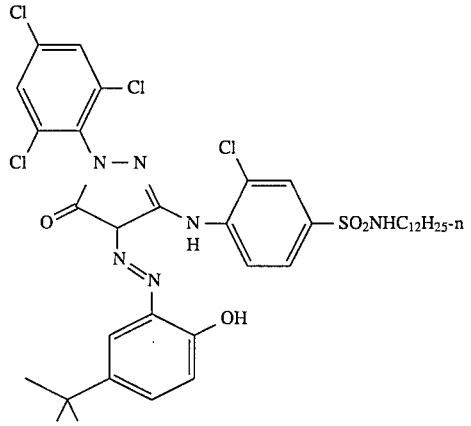
I-12
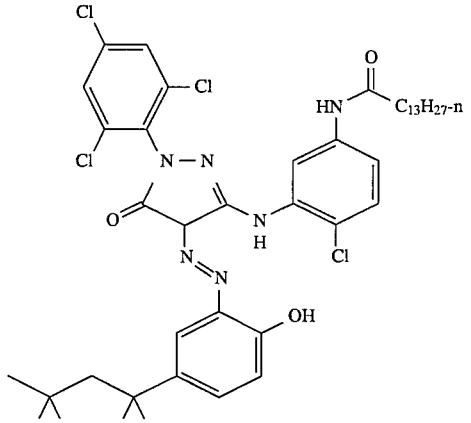
I-13
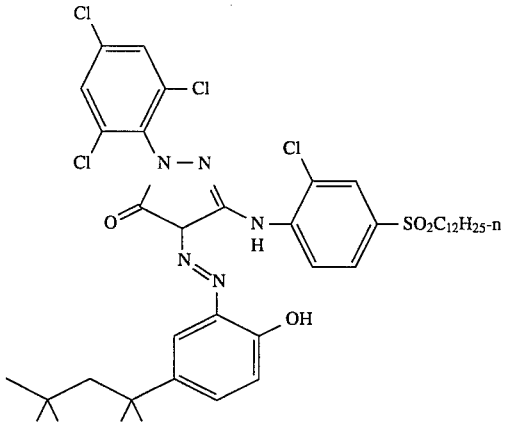

TABLE III-continued
I-14
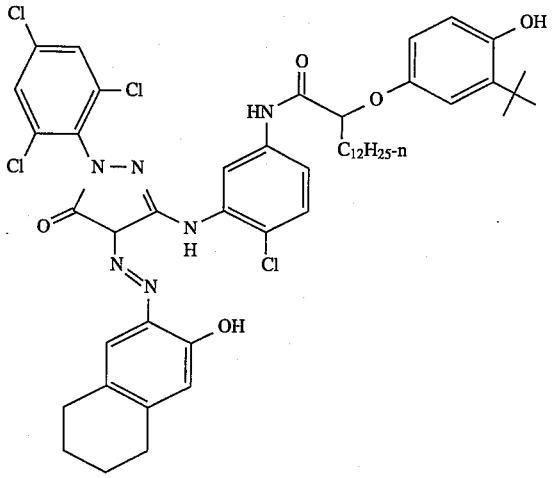
I-15
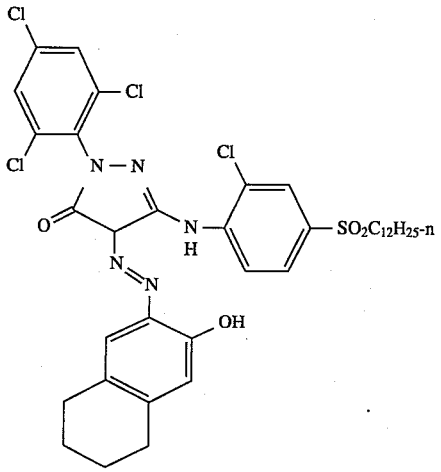
I-16
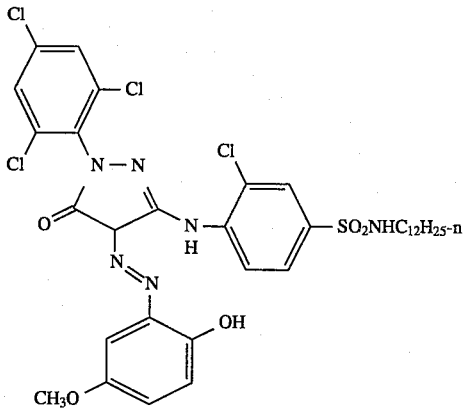

TABLE III-continued
I-17
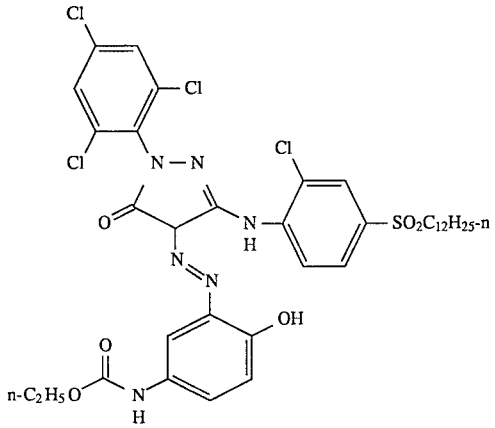
I-18
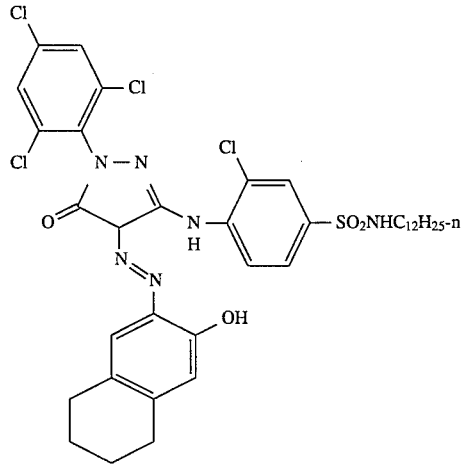
I-19
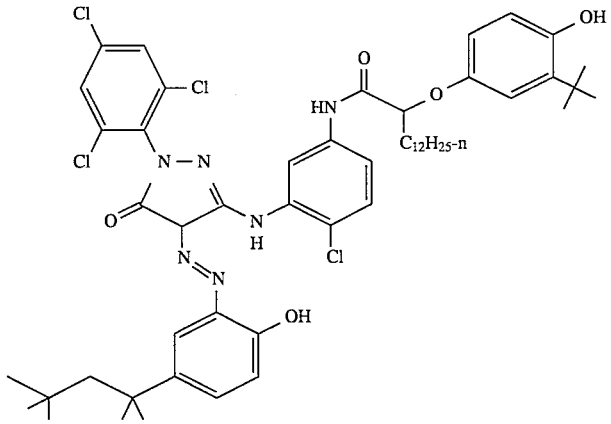

TABLE III-continued

I-20

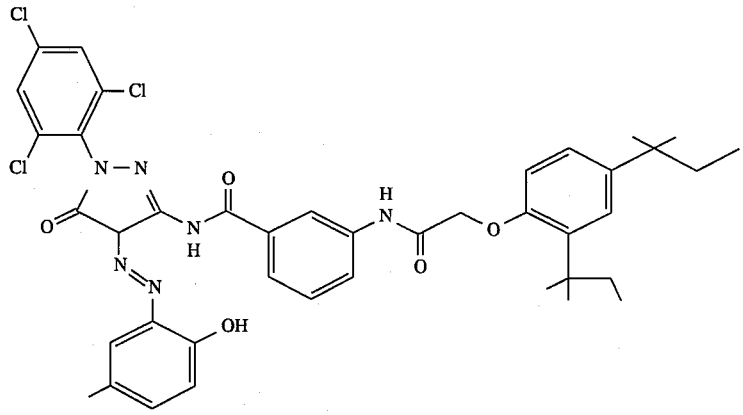

I-21

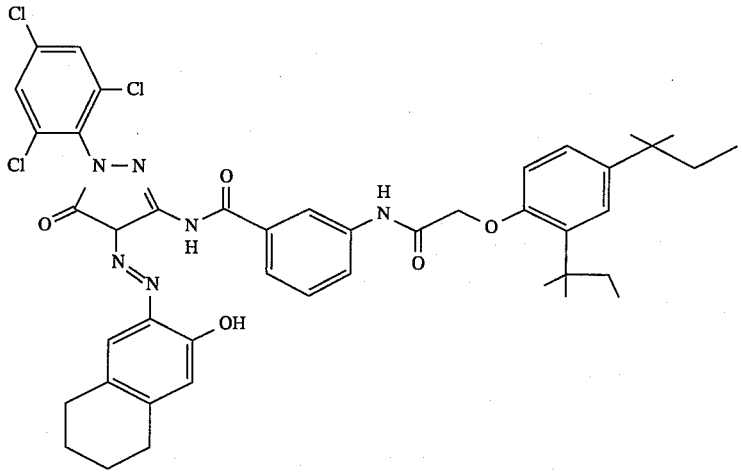

I-22

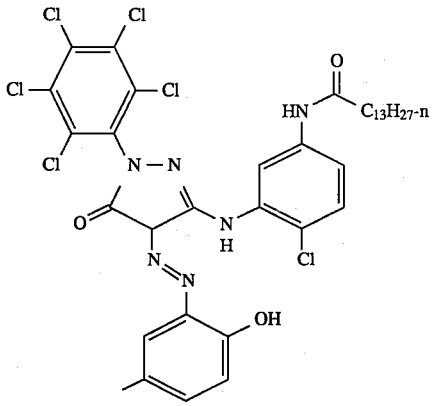

The masking couplers of this invention can be prepared by synthetic techniques well known to those skilled in the chemical art, such as by methods shown in U.S. Pat. Nos. 4,277,559, 4,163,670, 4,070,191, and 2,983,608. An illustrative synthesis is shown below.

Typically, a masking coupler of this invention is dispersed in the photographic element in a high-boiling organic compound known in the art as a coupler solvent. Representative coupler solvents include phthalic acid alkyl esters such as dibutyl phthalate and dioctyl phthalate, phosphoric acid esters such as tritolyl phosphate, triphenyl phosphate, tris-2-ethylhexyl phosphate, and tris-3,5,5-trimethylhexyl phosphate, citric acid esters such as tributyl acetylcitrate, benzoic acid esters such as octyl benzoate, aliphatic amides such as N,N-diethyl lauramide, and alkyl phenols such as 2,4-di-t-butyl phenol. Especially preferred coupler solvents are the phosphate esters, like tritolyl phosphate, which can be used alone or in combination with one another or with other coupler solvents.

The masking coupler, is typically coated in the element at a coverage of from 0.01 mmol/$m^2$ to 1.0 mmol/$m^2$, and preferably at a coverage of from 0.05 to 0.50 mmol/$m^2$. When a coupler solvent is employed, it typically is present in an amount of 0.25 to 5.0 mg. per mg. coupler, and preferably in an amount of 0.5 to 2.0 mg. per mg. coupler.

In those embodiments of this invention where the masking coupler is employed in combination with a pyrazoloazole image coupler, improvements in image coupler stability can be obtained if there is also present in the same layer as the masking coupler an electron rich aromatic ring and/or a 5-pyrazolone having bonded to the coupling site only hydrogen. This is discussed in more detain in Kapp et al. U.S. patent applications 08/129,840 and 08/130,035 both filed Sep. 30, 1993.

The multicolor photographic elements of this invention contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

Photographic elements of this invention can have the structures and components shown on Research Disclosure, February 1995, Item 37038, pages 79–114. Research Disclosure is published by Kenneth Mason Publications, Ltd., Dudley Annex, 12a North Street, Emsworth, Hampshire P010 7DQ, ENGLAND. Photographic elements of the present invention can be imagewise exposed and processed using known techniques and compositions, including those described in the Research Disclosure Item 37038 cited above.

The following examples further illustrate this invention.

EXAMPLE 1

Synthesis of Coupler I-4

A solution of 1.47 g of sodium nitrite in 9.1 mL of water was slowly added to a cooled solution (0 ° C.) of 2.6 g 2-amino-p-cresol dissolved in 27.1 mL acetic acid, 9.1 mL propionic acid, and 4 mL of concentrated hydrochloric acid. The diazotization reaction was stirred for 45 minutes at 0 ° C. The resulting solution of diazonium cation was then added slowly to a solution cooled to 0 ° C. of 12.5 g of pyrazolone coupler M-3 dissolved in 50 mL pyridine. The reaction mixture was stirred with gradual warming for 18 hours; then added to 400 mL of a 10% HCl solution and stirred for 20 minutes. The resultant dark red solid was filtered, washed with methanol and dried to provide a quantitative yield of the crude azopyrazolone. The azopyrazolone was purified by recrystallization from hot methanol and tetrahydrofuran give a dark red solid. Elemental analysis results are consistent with the desired azopyrazolone: 54.77% C, 5.87% H, 10.05% N; theoretical 55.14% C, 5.97% H, 10.15% N.

EXAMPLE 2

Monolayer Photographic Evaluation

A photographic element, identified as Element 101, was prepared by coating the following layers in the order shown on a cellulose acetate support:

Layer 1:

2.69 g/m$^2$ gelatin;

0.91 g/m$^2$ silver bromoiodide (as Ag);

0.22 millimoles/m$^2$ (0.20 g/m$^2$) azopyrazolone masking coupler YM-1 dispersed in twice its weight of tritolylphosphate;

0.015 g/m$^2$ (1,2,4)Triazolo(1,5-a)pyrimidin-7-ol, 5-methyl-, sodium salt;

3.77 g/m$^2$ gelatin;

Layer 2:

Bisvinylsulfonylmethyl ether at 1.75% total gelatin.

Photographic elements 102 to 114 were prepared by replacing the azopyrazolone masking coupler YM-1 with an equimolar amount of one of the azopyrazolone masking couplers shown in Table IV.

Strips of each element were exposed to white light through a graduated density step tablet, then developed for 3.25 minutes at 38 ° C. in the following color developer, stopped, washed, bleached, fixed and dried.

| Color Developer: | |
|---|---|
| Distilled water | 800 mL |
| Sodium Metabisulfite | 2.78 g |
| Sodium Sulfite, anhydrous | 0.38 g |
| CD-4 (color developer)* | 4.52 g |
| Potassium Carbonate, anhydrous | 34.3 g |
| Potassium Bicarbonate | 2.32 g |
| Sodium Bromide | 1.31 g |
| Potassium Iodide | 1.20 mg |
| Hydroxylamine Sulfate (HAS) | 2.41 g |
| Diethylenetriaminepentacetic acid, pentasodium salt (40% solution) | 8.43 g |
| Distilled water | to 1 L |
| Adjust pH to 10.0 | |

*CD-4 is 4-amino-3-methyl-N-ethyl-N-beta-hydroxy-ethylaniline sulfate.

Processed images were read with a Status M green filter and the maximum density generated by the azopyrazolone was determined.

The data for the processed coatings are given in Table IV, where C indicates a comparison masking coupler and I indicates a masking coupler of this invention.

The structures of the comparison couplers are given below and the structures of the inventive couplers are shown in Table III, above:

YM-1

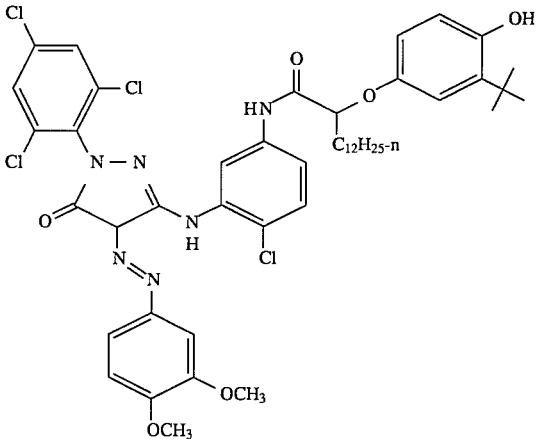

-continued

YM-2

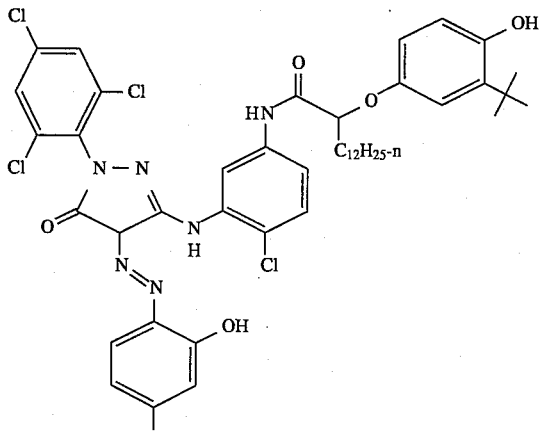

YM-3

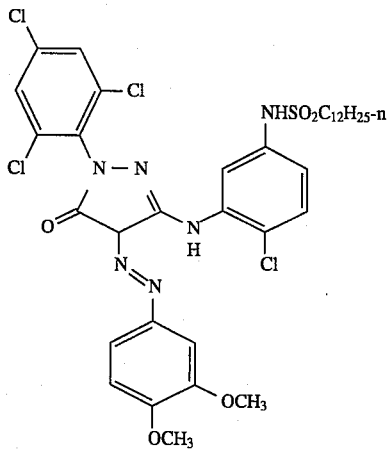

YM-4

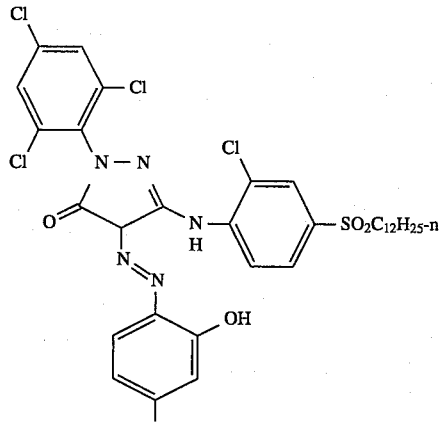

TABLE IV

| Maximum Green Density Generated by Azopyrazolone Couplers | | | |
|---|---|---|---|
| Element | Coupler | Dmax | C-I |
| 101 | YM-1 | 0.69 | C |
| 102 | YM-2 | 1.14 | C |
| 103 | I-3 | 1.03 | I |
| 104 | I-19 | 0.98 | I |
| 105 | I-10 | 1.03 | I |
| 106 | I-14 | 1.08 | I |
| 107 | I-12 | 0.94 | I |
| 108 | YM-3 | 0.71 | C |
| 109 | I-4 | 0.93 | I |

TABLE IV-continued

| Maximum Green Density Generated by Azopyrazolone Couplers | | | |
|---|---|---|---|
| Element | Coupler | Dmax | C-I |
| 110 | YM-4 | 1.02 | C |
| 111 | I-1 | 0.95 | I |
| 112 | I-8 | 0.98 | I |
| 113 | I-13 | 1.02 | I |
| 114 | I-15 | 0.91 | I |

As can be seen from Table IV, azopyrazolone masking couplers containing a 2'-hydroxy group generated significantly greater density under conditions of excess oxidized color developer than the azopyrazolones which did not contain a 2-hydroxy group.

Unexposed strips of each element were processed without developer in order to determine the spectra of the azopyrazolone masking coupler. The spectra were recorded on a Perkin Elmer Lambda 4B UV/VIS Spectrophotometer. The wavelength and maximum absorbance data are given in Table V, below.

TABLE V

| Wavelength and Maximum Absorbance of Azopyrazolones | | | | |
|---|---|---|---|---|
| Element | Coupler | Lambda Max | Max Abs. | C/I |
| 101 | YM-1 | 440 | 0.548 | C |
| 102 | YM-2 | 438 | 0.686 | C |
| 103 | I-3 | 438 | 0.512 | I |
| 104 | I-19 | 437 | 0.569 | I |
| 106 | I-14 | 447 | 0.752 | I |
| 110 | YM-4 | 438 | 0.577 | C |
| 111 | I-1 | 437 | 0.556 | I |
| 113 | I-13 | 437 | 0.566 | I |

The data in Table V demonstrate that the effect of substitution at the 4' and 5' positions on the absorbance spectra of the azopyrazolone masking coupler is equivalent. Simultaneous substitution of both positions by a cycloannulated ring gave a bathochromic shift relative to the monosubstituted couplers. For all of the azopyrazolones studied the imagewise coupling of the masking coupler resulted in the loss of the blue density from the azopyrazolone coupler, thus demonstrating that the original color of the masking coupler was destroyed upon coupling to form a magenta dye. Thus, the coupler would be effective to mask any unwanted blue absorption in a dye formed from it or an associated coupler.

EXAMPLE 3

Multilayer Photographic Evaluation

Photographic Element 201 was prepared by coating the following layers in the order shown on a cellulose acetate support. The quantities of silver halide are given in grams of silver per $m^2$ while the quantities of other materials are given in grams per $m^2$.

Layer 1 {Antihalation Layer} black colloidal silver sol containing 0.236 g of silver, with 2.44 g gelatin.

Layer 2 {First (least) Red Light Sensitive Layer} Red sensitized silver iodobromide emulsion [1.3 mol % iodide, average grain diameter 0.55 microns, average grain thickness 0.08 microns] at 0.42 g, red sensitized silver iodobromide emulsion [4 mol % iodide, average grain diameter 1.0 microns, average grain thickness 0.09 microns] at 0.45 g, cyan dye-forming image coupler C-1 at 0.55 g, cyan dye-forming masking coupler CM-1 at 0.028 g, BAR compound B-1 at 0.039 g, with gelatin at 1.83 g.

Layer 3 {Second (more) Red light Sensitive Layer} Red sensitive silver iodobromide emulsion [4 mol % iodide, average grain diameter 1.3 microns, average grain thickness 0.12 microns] at 0.72 g, cyan dye-forming image coupler C-1 at 0.23 g, cyan dye-forming masking coupler CM-1 at 0.022 g, DIR compound D-1 at 0.011 g, with gelatin at 1.66 g.

Layer 4 {Third (most) Red Light Sensitive Layer} Red sensitized silver iodobromide emulsion [4 mol % iodide, average grain diameter 2.6 microns, average grain thickness 0.13 microns] at 1.10 g, cyan dye-forming image coupler C-1 at 0.14 g, cyan dye forming masking coupler CM-1 at 0.033 g, DIR compound D-1 at 0.021 g, DIR compound D-2 at 0.050 g, with gelatin at 1.36 g.

Layer 5 {Interlayer} Yellow dye material YD-1 at 0.077 g and 1.33 g of gelatin.

Layer 6 {First (least) Green Sensitive Layer} Green sensitized silver iodobromide emulsion [1.3 mol % iodide, average grain diameter 0.55 microns, average grain thickness 0.08 microns] at 0.55 g, green sensitized silver iodobromide emulsion [4 mol % iodide, average grain diameter 1.0 microns, average grain thickness 0.09 microns] at 0.29 g, magenta dye-forming image coupler MC-1 at 0.26 g, magenta dye-forming masking coupler YM-1 at 0.066 g, with gelatin at 1.78 g.

Layer 7 {Second (more) Green Light Sensitive Layer} Green sensitized silver iodobromide emulsion [4 mol % iodide, average grain diameter 1.2 microns, average grain thickness 0.12 microns] at 1.00 g, magenta dye-forming image coupler MC-1 at 0.083 g, magenta dye-forming masking coupler YM-1 at 0.066 g, DIR compound D-1 at 0.024 g, with gelatin at 1.48 g.

Layer 8 {Third (most) Green Light Sensitive Layer} Green sensitized silver iodobromide emulsion [4 mol % iodide, average grain diameter 2.16 microns, average grain thickness 0.12 microns] at 1.00 g, magenta dye-forming image coupler MC-1 at 0.064 g, magenta dye-forming masking coupler YM-1 at 0.055 g, DIR compound D-3 at 0.011 g, DIR compound D-4 at 0.011 g, with gelatin at 1.33 g.

Layer 9 {Interlayer} Yellow dye material YD-2 at 0.11 g with gelatin at 1.33 g.

Layer 10 {First (less) Blue light Sensitive Layer} Blue sensitized silver iodobromide emulsion [1.3 mol % iodide, average grain diameter 0.55 microns, average grain thickness 0.08 microns] at 0.25 g, blue sensitized silver iodobromide emulsion [6 mol % iodide, average grain diameter 0.96 microns, average grain thickness 0.26 microns] at 0.65 g, yellow dye forming image coupler Y-1 at 0.76 g, yellow dye-forming image coupler Y-2 at 0.29 g, DIR compound D-5 at 0.066 g, BAR compound B-1 at 0.003 g, with gelatin at 2.6 g.

Layer 11 {Second (more) Blue Light Sensitive Layer} Blue sensitized silver iodobromide emulsion [4 mol % iodide, average grain diameter 3.0 microns, average grain thickness 0.14 microns] at 0.23 g, blue sensitized silver iodobromide emulsion [9 mol % iodide, average grain diameter 1.0 microns] at 0.58 g, yellow dye-forming image coupler Y-1 at 0.19 g, yellow dye-forming image coupler Y-2 at 0.072 g, DIR compound D-5 at 0.050 g, BAR compound B-1 at 0.006 g, with gelatin at 1.97 g.

Layer 12 {Protective Layer} 0.106 g of dye UV-1, 0.106 g of dye UV-2, unsensitized silver bromide Lippman emulsion at 0.222 g, with gelatin at 2.03 g.

This coating was hardened with 1.75% by weight of total gelatin with hardener H-1.

Surfactants, coating aids, scavengers, soluble absorber dyes and stabilizers were added to the various layers of this sample as is commonly practiced in the art.

The formulas for the component materials are as follows:

C-1:

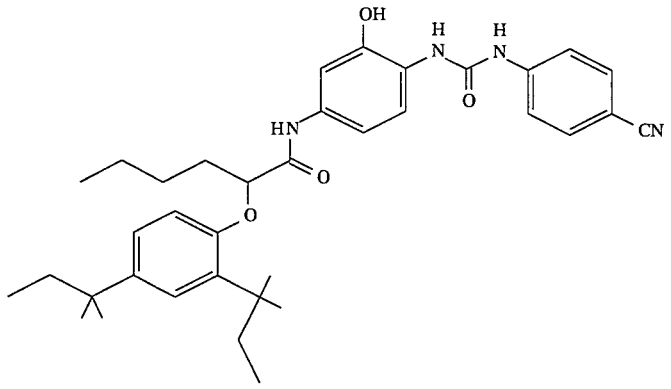

-continued
CM-1:
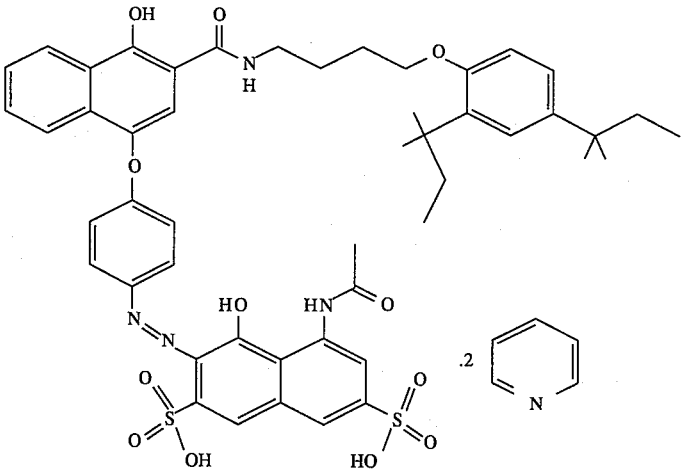
B-1:
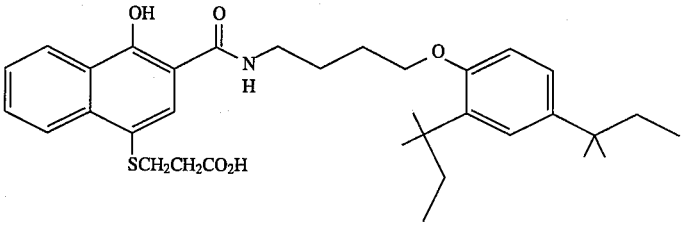
D-3:
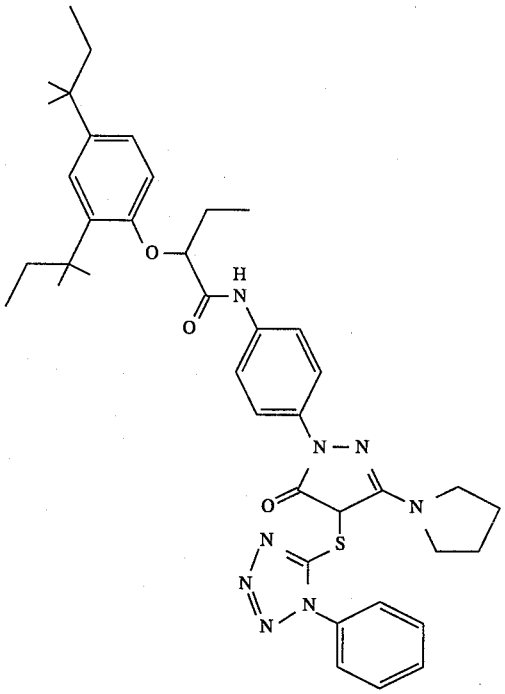

-continued
D-4:
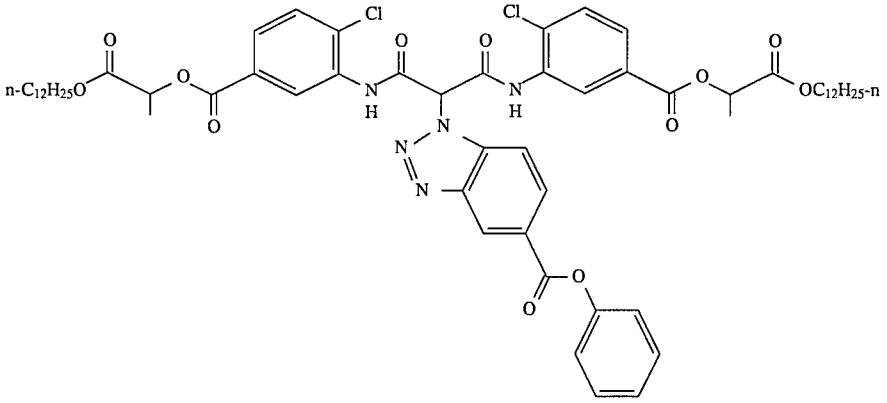
D-5:
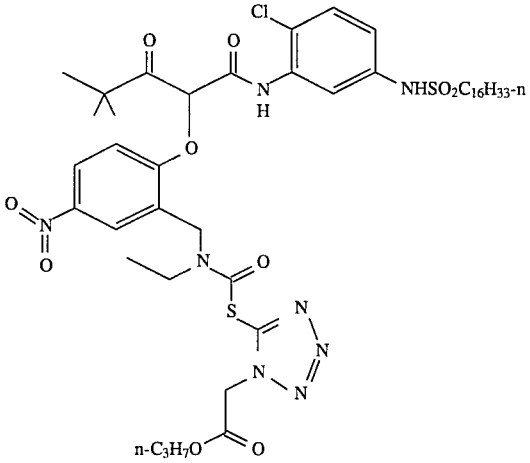
Y-1:
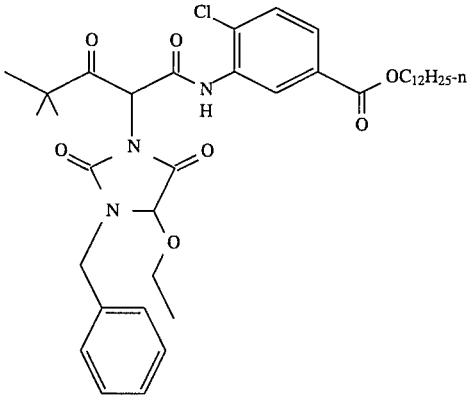

-continued
Y-2:
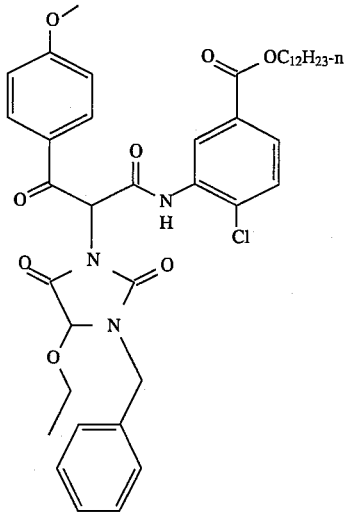
MC-1:
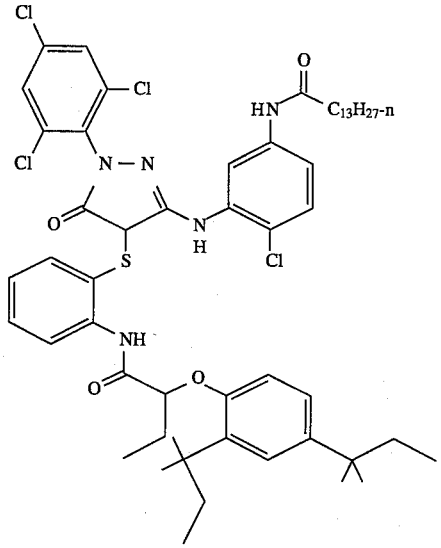
YD-1:
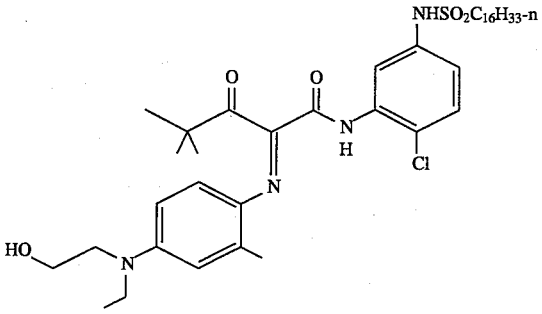

-continued

YD-2:

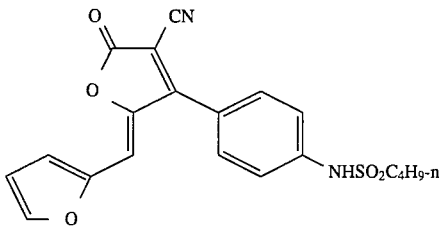

UV-1:

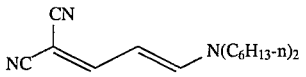

UV-2:

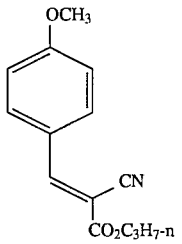

H-1:

$CH_2(SO_2CH{=}CH_2)_2$

Photographic Element 202 was prepared like Photographic Element 201 except: 1) magenta dye-forming masking coupler YM-1 in layers 6, 7, and 8 was replaced with equimolar amounts of magenta dye-forming-masking coupler 1-14 at levels of 0.065 g, 0.065 g, and 0.054 g, respectively; and 2) magenta dye-forming image coupler MC-1 in layers 6, 7, and 8 were lowered to levels 0.242 g, 0.061 g, and 0.044 g, respectively.

Photographic Element 203 was prepared like Photographic Element 201 except: 1) magenta dye-forming masking coupler YM-1 in layers 6, 7, and 8 was replaced with eqimolar amounts of magenta dye-forming masking 5 coupler I-3 at levels of 0.062 g, 0.062 g, and 0.052 g, respectively; and 2) magenta dye-forming image coupler MC-1 in layers 6, 7, and 8 were lowered to levels 0.242 g, 0.061 g, and 0.044 g, respectively.

The coatings were exposed to green light through a graduated density step tablet, then processed according to the conventional color negative development process.

The action of the masking coupler was determined by measuring the difference in blue and green densities at an exposure in the toe of the sensitometric curve sufficient to give a green density approximately +0.3 above Dmin and at an exposure 1.0 logE higher. The efficiency of masking is determined by the ratio of loss of blue density due to destruction of the azopyrazolone versus the gain in green density due to imagewise generation of magenta dyes. The results of these measurements are reported in Tables VI and VII, below.

TABLE VI

| | | | Masking Efficiency | | | |
|---|---|---|---|---|---|---|
| Element | C/I | Green Toe Density | Blue Toe Density | Green Delta D at +1.0 LogE | Blue Delta D at +1.0 LogE | Blue Delta D/ Green Delta D |
| 201 | C | 0.976 | 0.757 | 0.793 | −0.043 | −0.054 |
| 202 | I | 0.927 | 0.787 | 0.734 | −0.054 | −0.074 |
| 203 | I | 0.931 | 0.766 | 0.804 | −0.046 | −0.057 |

Another series of multilayer photographic elements was exposed and processed in a similar fashion. Photographic Element 301 was like Photographic Element 201 except the level of hardener H-1 was 2.0% by weight of total gelatin.

Photographic Element 302 was like Photographic Element 301 except: 1) magenta dye-forming masking coupler YM-1 in layers 6, 7, and 8 was replaced with equimolar amounts of magenta dye-forming masking coupler I-15 at levels of 0.055 g, 0.055 g, and 0.045 g, respectively; and 2) magenta dye-forming image coupler MC-1 in layers 6, 7, and 8 were lowered to levels 0.242 g, 0.061 g, and 0.044 g, respectively.

TABLE VII

| | | | Masking Efficiency | | | |
|---|---|---|---|---|---|---|
| Element | C/I | Green Toe Density | Blue Toe Density | Green Delta D at +1.0 LogE | Blue Delta D at +1.0 LogE | Blue Delta D/ Green Delta D |
| 301 | C | 0.884 | 0.726 | 0.755 | −0.044 | −0.058 |
| 302 | I | 0.921 | 0.798 | 0.860 | −0.072 | −0.084 |

The data in the above tables VI and VII show that multilayer photographic elements incorporating the inventive azopyrazolone masking couplers gave similar gradation in green density and improved masking of blue density. Thus, the azopyrazolone masking couplers of the invention are more efficient and allow for a reduction in the amount of image coupler while still providing the desired green density scale.

The invention has been described by reference to preferred embodiments, but it will be understood changes can be made to the embodiments specifically described herein within the spirit and scope of the invention.

What is claimed is:

1. A multilayer silver halide color photographic element comprising a support bearing a light-sensitive silver halide emulsion layer and a yellow-colored magenta dye-forming masking coupler wherein the masking coupler is a ballasted 5'-substituted-2'-hydroxy-4-phenylazo-5-pyrazolone represented by the structural formula:

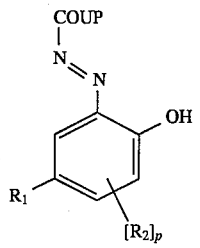

wherein:

COUP is a 5-pyrazolone dye forming coupler having the azo group attached to its coupling position;

$R_1$ and $R_2$ each independently represents a substituent with a Hammett sigma-para value of less than 0.05 selected from the group consisting of an alkyl group, an aryl group, an amino group, a ureido group, an alkoxy group and an aryloxy group, or together $R_1$ and $R_2$ represents an alkylene group with a Hammett sigma-para value of less than 0.05; and p is an integer of 0 to 3.

2. A photographic element of claim 1, wherein COUP is a 5-pyrazolone coupler having an anilino group in the 3-position.

3. A photographic element of claim 2, wherein:

$R_1$ is an alkyl group of 1 to 10 carbon atoms; and p is 0or 1.

4. A photographic element of claim 3, wherein:

p is 1; and $R_2$ is a 3'-alkyl group of 1 to 10 carbon atoms.

5. A photographic element of claim 2, wherein:

p is 1;

$R_2$ is in the 4'-position; and together $R_1$ and $R_2$ represent an n-butylene group.

6. A photographic element of claim 1 having a masking coupler selected from those with the structures:

I-2

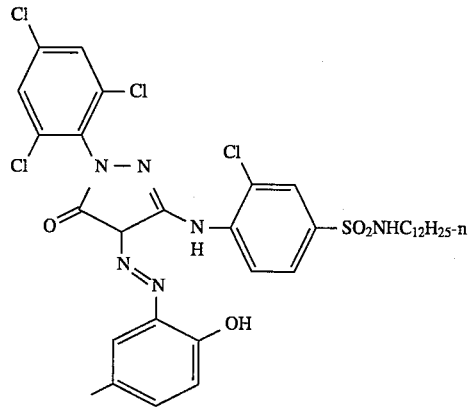

I-4

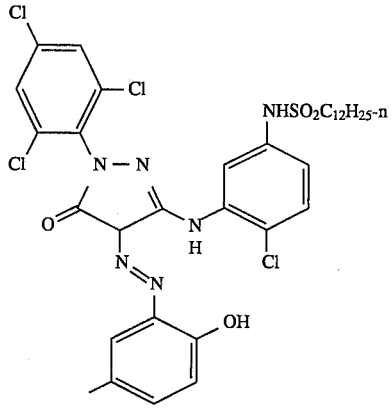

I-10

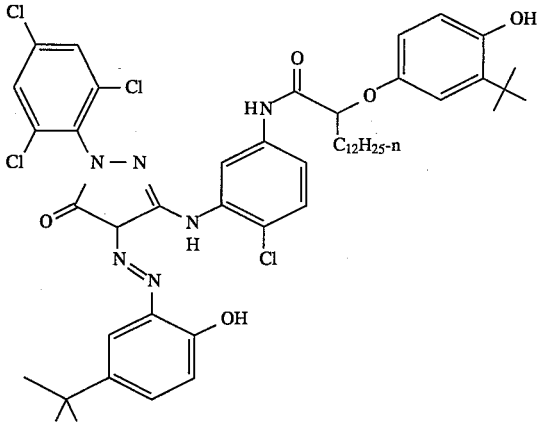

I-12
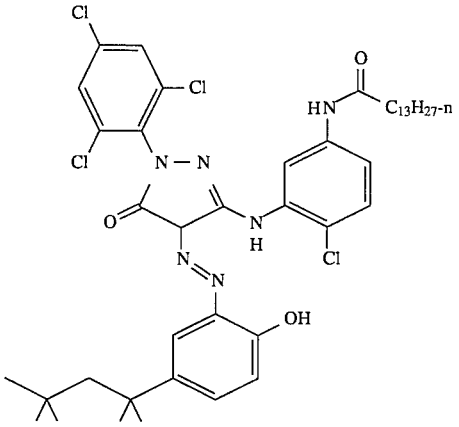
I-14
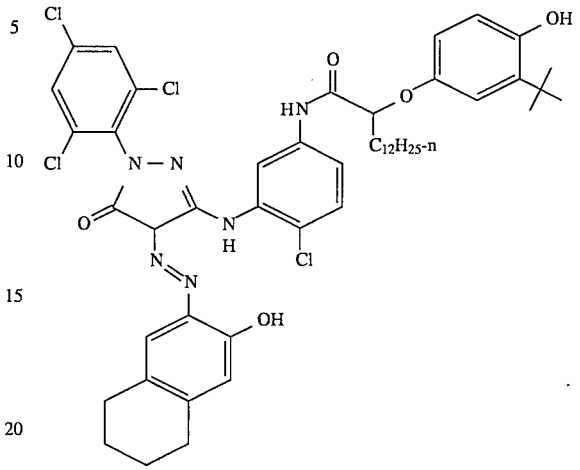
7. A color negative photographic element of claim 1, comprising a transparent support.
* * * * *